United States Patent [19]

Schechter et al.

[11] Patent Number: 4,541,394

[45] Date of Patent: Sep. 17, 1985

[54] FUEL INJECTION PUMP

[75] Inventors: Michael M. Schechter, Southfield; Aladar O. Simko, Dearborn Heights, both of Mich.

[73] Assignee: Ford Motor Company, Dearborn, Mich.

[21] Appl. No.: 689,270

[22] Filed: Jan. 7, 1985

[51] Int. Cl.[4] ..... F02M 41/00; F02M 59/00

[52] U.S. Cl. ..... 123/506; 123/458; 123/451; 417/505; 417/516

[58] Field of Search ..... 123/506, 451, 458, 459, 123/447, 299, 300, 500, 501; 417/279, 505, 515–518

[56] References Cited

U.S. PATENT DOCUMENTS

| | | | |
|---|---|---|---|
| 1,630,957 | 5/1927 | Lundstrom | 123/506 |
| 1,668,919 | 5/1928 | Lundstrom | 123/506 |
| 3,744,465 | 7/1973 | Voss | 123/451 |
| 4,379,442 | 4/1983 | Simko | 123/458 |
| 4,385,614 | 5/1983 | Eheim | 417/279 |
| 4,406,267 | 9/1983 | Sharma | 123/459 |
| 4,445,484 | 5/1984 | Marion | 123/506 |
| 4,459,963 | 7/1984 | Gross | 123/506 |
| 4,486,152 | 12/1984 | Porel | 417/515 |
| 4,497,299 | 2/1985 | Schechter | 123/458 |

FOREIGN PATENT DOCUMENTS

| | | | |
|---|---|---|---|
| 0057942 | 7/1946 | Netherlands | 123/451 |

*Primary Examiner*—Carl Stuart Miller

*Attorney, Agent, or Firm*—Clifford L. Sadler; Robert E. McCollum

[57] ABSTRACT

A fuel injection pump of the radial plunger, spill port type includes electromagnetic means for opening and closing the spill port to control the pressurization of fuel for injection of fuel to the individual engine cylinders; a single solenoid assembly controlling the flow of fuel to and from a pair of pumping plungers in response to the movement of a shuttle valve mechanism; in one embodiment, a single retraction type delivery valve is used in connection with each pumping plunger and, in a separate embodiment, a single retraction type delivery valve is integrated with the shuttle valve mechanism which controls the individual delivery of fuel to a pair of engine cylinders.

15 Claims, 10 Drawing Figures

FUEL INJECTION PUMP

This invention relates in general to an automotive type fuel injection pump. More particularly, it relates to one of the multiple plunger, spill port type in which the spill ports are electromagnetically controlled, a single solenoid controlling the supply and discharge of fuel to and from two plunger barrels by means of a hydraulically operated shuttle valve mechanism.

Plunger type fuel injection pumps with solenoid controlled spill ports and fuel delivery valves axially aligned with the plunger barrel are known. For example, U.S. Pat. No. 4,379,442, Simko, assigned to the assignee of this invention, shows such a construction. However, the reference device requires a separate solenoid for control of the flow from each plunger fuel chamber in the engine. This is both uneconomical and inefficient.

U.S. Pat. No. 4,497,299, Schechter, Plunger Type Fuel Injection Pump, also assigned to the assignee of this invention, shows a multi-plunger, spill port type pump having a single solenoid controlling the fuel flow operation with respect to two plungers. However, a fuel distribution plunger activated by the camshaft also is required in combination with each of two fuel pumping plungers.

The fuel injection pump of this invention provides an efficient and economical construction. It provides for the supply and discharge of fuel to and from the plunger barrels of two plungers by the use of only a single solenoid controlled valve and a hydraulically operated shuttle valve.

A further feature of the invention is the provision of a spill port control valve designed to be insensitive to the magnitude of the injection pressure acting against it.

Other features of the invention are, in one embodiment, the incorporation of a retraction type fuel delivery valve in axial alignment with each pumping plunger, while in another embodiment, the delivery valve is integrated with the shuttle valve so that only one delivery valve need be used to control the flow to a pair of engine cylinders.

Other objects, features and advantages of the invention will become more apparent upon reference to the succeeding, detailed description thereof, and to the drawings illustrating the preferred embodiments thereof; wherein, FIG. 1 is a cross-sectional view of a portion of an internal combustion engine incorporating a fuel injection pump embodying the invention;

Figure 1:
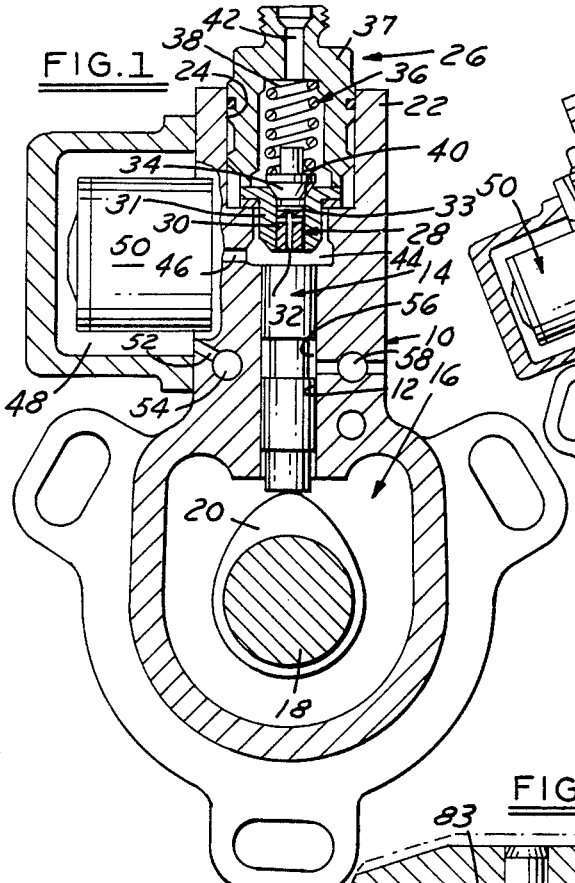
FIG. 1A is a cross-sectional view on a reduced scale of a portion of an engine similar to that shown in FIG. 1, and embodying the invention.

FIG. 1 illustrates schematically a cross-sectional view of a portion of an internal combustion engine incorporating a fuel injection pump constructed according to the invention. It includes a housing 10 having at least a pair of axially spaced radially extending bores 12 within each of which is reciprocably mounted a pump plunger 14. Housing 10, which is aluminum in this case, has a central cavity 16 within which is received a short engine driven camshaft 18. The camshaft is rotatably mounted at opposite ends on a pair of ballbearing units, not shown.

Camshaft 18, in this case, is formed with a single cam 20 that is eccentrically mounted for reciprocation of all of the pumping plungers 10 engageable therewith. The bottom of the plunger is flat, and the plungers ride directly on the cam. While not shown, the cam profile would consist of an acceleration ramp, a constant volocity portion (Archimedies spiral) and a deceleration ramp.

The upper end 22 of housing 10 is formed with a cup shaped recess 24 in which is fixedly mounted a fuel delivery valve assembly 26. The assembly includes a known type of retraction type delivery valve 28. It has a flow cutoff land 30 at its lower end of a diameter that mates with the diameter of a subhousing 31 in which it is slidably mounted. An axial bore 32 connects fuel at the lower end of land 30 to a cross-bore 33. A second larger diameter conical land 34 is formed at its upper end that moves into a fuel chamber 36 formed in the delivery valve housing 37. A spring 38 biases the delivery or retraction valve onto a mating seat 40 formed in subhousing 31. A throughbore 42 connects the upper end of fuel chamber 36 to a fuel injection line or conduit for the individual injection of fuel into an engine cylinder in a known manner.

The space between the lower end of subhousing 31 of the delivery valve and the top of plunger 10 defines a fuel plenum or chamber 44 that alternately is pressurized with fuel to a level sufficient to open the delivery valve 28 for delivery of fuel to the individual engine cylinders during the pumping stroke of plunger 14, or replenished with fuel during the intake stroke of plunger 14. The pressurization of fuel in plenum 44 is controlled by an inlet-spill port type construction in a manner to be described in more detail later. Briefly, fuel is supplied to each plenum 44 through an inlet-spill port 46 from a chamber 48 containing an electromagnetically controlled valve means 50 for controlling flow through the port 46. Chamber 48 in turn is connected by a passage 52 to a fuel supply conduit 54. The latter would be connected to a low pressure supply pump, not shown. Fuel leaking past plunger 14 to a reduced diameter portion 56 of the plunger would be vented to a fuel return passage 58.

In operation, as thus far described, so long as spill port 46 remains open, upward movement of plunger 10 on its pumping stroke will merely move the fuel in chamber 44 out through the spill port 46 and back into the feed line 54. When spill port 46 is closed by the electromagnetically controlled valve means 50, plunger 14 then can pressurize the fuel in chamber 44 sufficient to move the delivery valve 28 upwardly against the preload of spring 38 to open the fuel line and thereby provide fuel to the individual cylinder. When plunger 14 moves downwardly during its intake stroke, the electromagnetic means 50 will be deenergized, and the pressure of fuel in injection line 42 will fall to a point where spring 38 will be able to move the retraction valve 28 downwardly into the bore of subhousing 32. The first effect is for the upper edge defining the cross-bore 33 to engage the bore and shut off the communication of fuel between the bore and line 42. The second effect upon continued movement of the delivery valve 28 is to decrease the residual pressure in the fuel injection line and chamber 36 by the mass of the retraction valve moving downwardly into the bore, which increases the effective volume in the spring chamber.

Figure 1A:
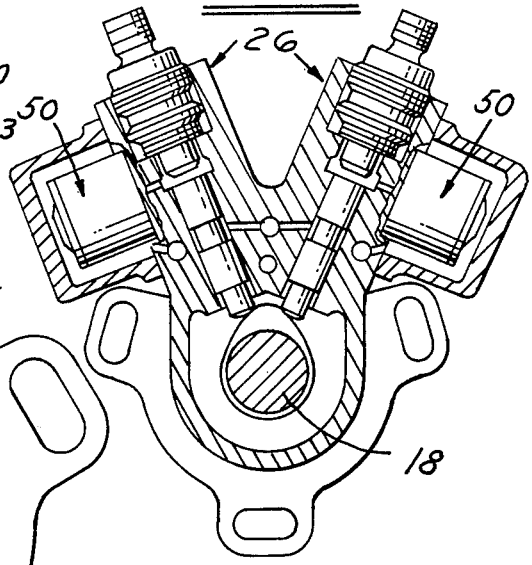

FIG. 1 shows a fuel injection pump assembly of the axially aligned plunger type suitable for an in-line four cylinder engine, for example. It would be equally applicable, however, to a V-type engine, such as is shown in FIG. 1A, for example, where two separate banks of fuel injection pump assemblies are shown interconnected in pairs.

Figure 2:
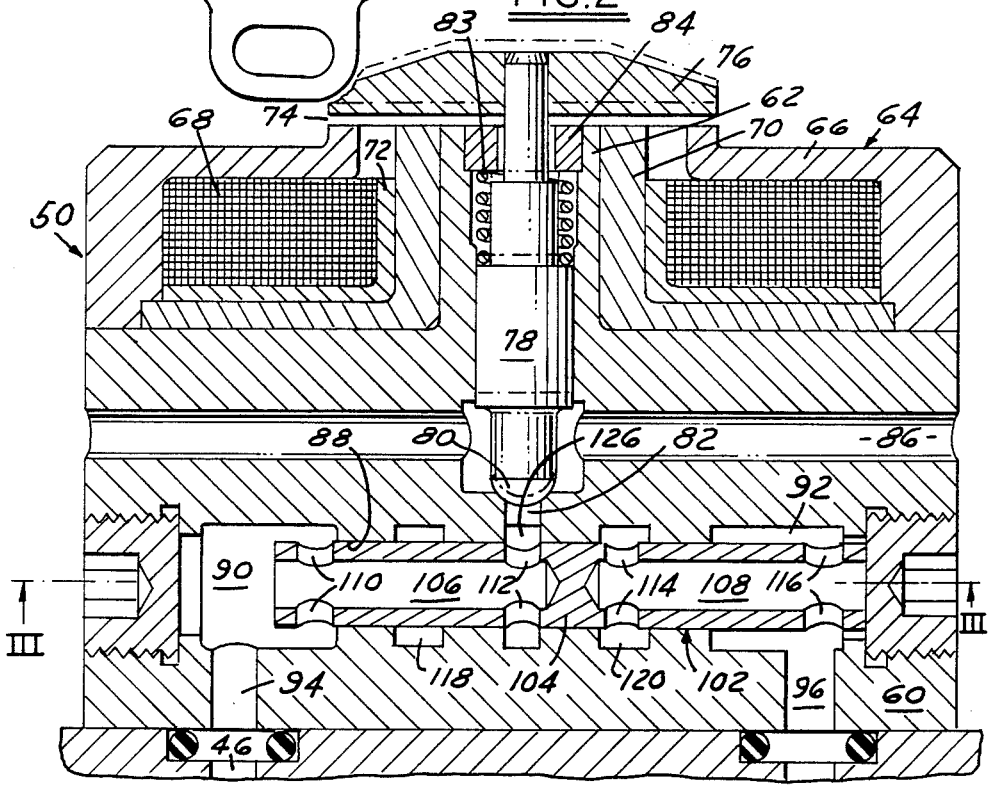
FIG. 2 is an enlarged cross-sectional view of a detail of FIG. 1.
Figure 3:
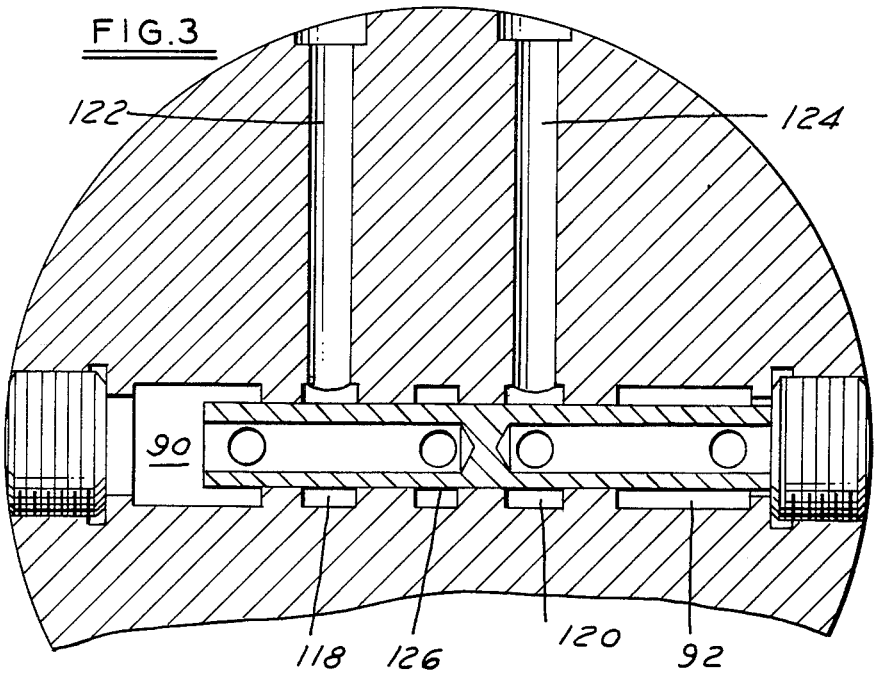
FIG. 3 is a cross-sectional view taken on a plane indicated by and viewed in the direction of the arrows III—III of FIG. 2.
Figure 4:
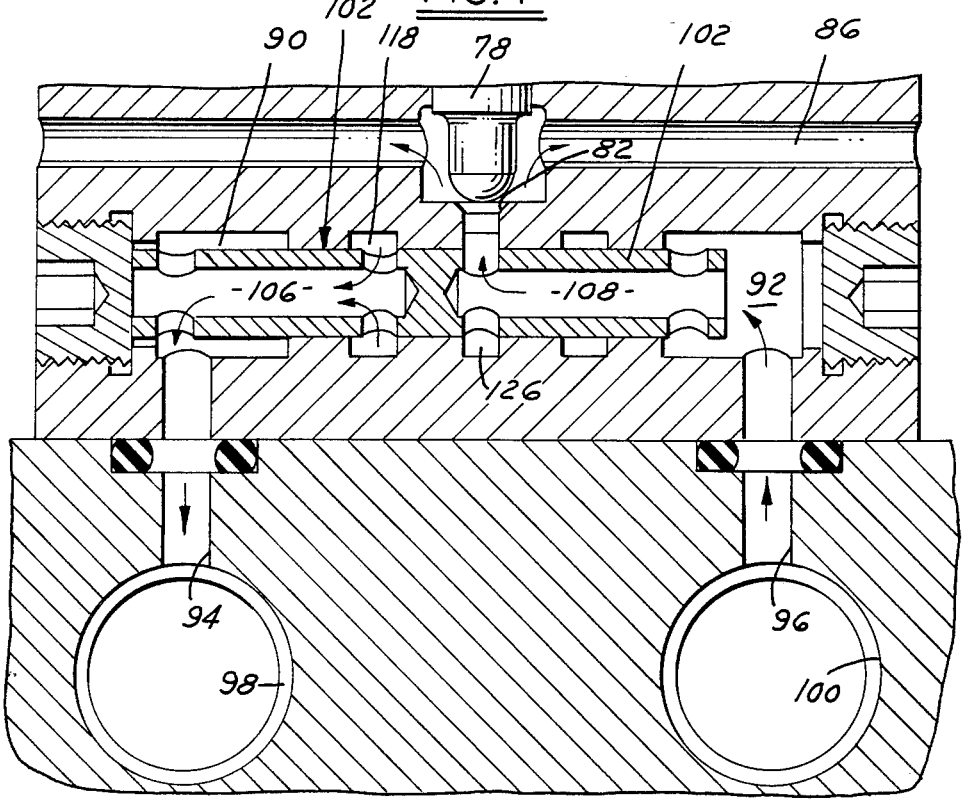
FIG. 4 is a cross-sectional view similar to that of FIG. 2 illustrating the parts in different operative positions.

FIGS. 2, 3 and 4 illustrate more clearly the construction of the electromagnetically controlled valve means 50 to control the opening or closing of the spill port 46. In this case, a common spill port is used to control fuel flow to and from a pair of plungers in an alternate manner so that when one fuel-plenum 44 is being pressurized with fuel upon closing of the spill port valve, the other plunger fuel chamber will be replenished with fuel during the intake stroke of its plunger.

More particularly, FIG. 2 shows the electromagnetically controlled valve means 50 as including a valve housing 60 having a sleeve-like portion 62 projecting from its upper end. Surrounding the latter sleeve portion is a solenoid assembly 64 that includes an outer core 66, a solenoid coil 68, and a pair of sleeve members 70 and 72. The usual air gap 74 is provided between the upper end of the sleeve members and core and the solenoid armature 76. The latter is fixedly secured to the end of a spill port control valve 78 which, at its lower end 80, cooperates with spill port 82. A spring 83, located between a seat 84 and a reduced diameter portion of valve 78, lightly biases the valve to a position closing spill port 82. It should be noted that the force of spring 83 is chosen such that the opening pressure of the spill port valve 78 will be less than the opening pressure of the retraction type delivery valve 28, so long as solenoid 64 is not energized. Associated with spill valve 78 is a low pressure fuel flow return line 86 connected to supply line 54.

As stated previously, one of the features of the invention is to provide for the control of flow of fuel to and from a pair of pump plungers by the use of a single solenoid controlled spill port valve. More particularly, the valve housing 60 includes a valve bore 88 that is closed at opposite ends by plugs, as shown, and enlarged at opposite ends to form annular fuel plenums 90 and 92. Plenums 90 and 92 are connected by passages 94 and 96 (spill port 46 in FIG. 1) to first and second plunger bores 98 and 100.

The flow between the two plunger bores and spill port 82 is controlled by a reciprocable shuttle valve 102. The latter is a sleeve-type valve having a central partition 104 dividing the interior of the valve into two axial bores 106 and 108. The wall of the valve is provided with a number of cross-holes or ports, 110, 112, 114 and 116 for the flow of fuel therethrough as a function of the reciprocatory position of the valve. Valve body 60 is provided with a pair of fuel supply annuli 118 and 120, symmetrically located on opposite sides of spill port 82. The annuli, as shown in FIG. 3 are connected to a pair of fuel supply lines 122 and 124 opening into chamber 48 (FIG. 1). A central fuel annulus 126 connects directly with spill port 46.

The shuttle valve 102 is hydraulically actuated between two alternate positions shown respectively in FIGS. 2 and 4. When shuttle valve 102 is in the extreme right hand position (as seen in FIG. 2), the left hand axial bore 106 is connected with annulus 126 through the cross hole 112, and the right hand axial bore 108 is connected with the supply line annulus 120 by cross hole 114. If spill valve 78 is in the open dotted line position indicated in FIG. 2, movement of plunger 14 in barrel or bore 98 upwardly through its pumping stroke will merely displace fuel into plenum 90, through bore 106, and out through cross hole 112 and annulus 126 past open valve 78 into return line 86, without injection of fuel to its associated engine cylinder. The pressure of the fuel against the end 80 of valve 78 is sufficient to overcome the force of spring 83, but not sufficient to overcome the preload of delivery valve spring 38. Simultaneously, the plunger in bore 100 will move downwardly on a fuel intake stroke causing fuel from supply line annulus 120 to flow through cross hole 114 and bore 108 and cross hole 116 into the plunger bore to refill its fuel chamber 44. If the spill valve 78 is in the closed position indicated in full lines in FIG. 2, then, upon movement of the plunger in bore 98 upwardly through its pumping stroke, the fuel in annulus 44 associated therewith will be pressurized to a level above the preload of delivery valve spring 38 moving the delivery valve open and injecting a quantity of fuel into the engine cylinder associated with line 42.

During the pumping stroke of the plunger in bore 98, for example, the pressure in plenum 90 will be higher than that in plenum 92. This pressure differential, the minimum value of which is determined by the preload of spill valve spring 83, maintains shuttle valve 102 in the extreme right hand position shown in FIG. 2. When the first plunger in bore 98 passes its top dead center position and begins its downward suction stroke, the pressure in plenum 90 will drop below the level of the supply pressure in plenum 92. This pushes the shuttle valve 102 to the extreme left hand position, as shown in FIG. 4. In this position of the shuttle valve, the plunger in bore 100, which is now on its pumping stroke, is connected with spill port 82 through plenum 92 and shuttle valve bore 108. The plunger in bore 98, which is on its suction stroke, now is connected to the supply line through annulus 118 in shuttle valve bore 106. When the solenoid 64 is energized, spill valve 78 will seat in port 82. This will permit the pressurization of fuel in the plunger chamber 44 associated with plunger bore 100 and effect the injection of fuel to its respective engine cylinder. Thus, during a single camshaft revolution, the solenoid 64 will be energized twice, each time causing fuel injection into one of two separate engine cylinders.

Figure 5:
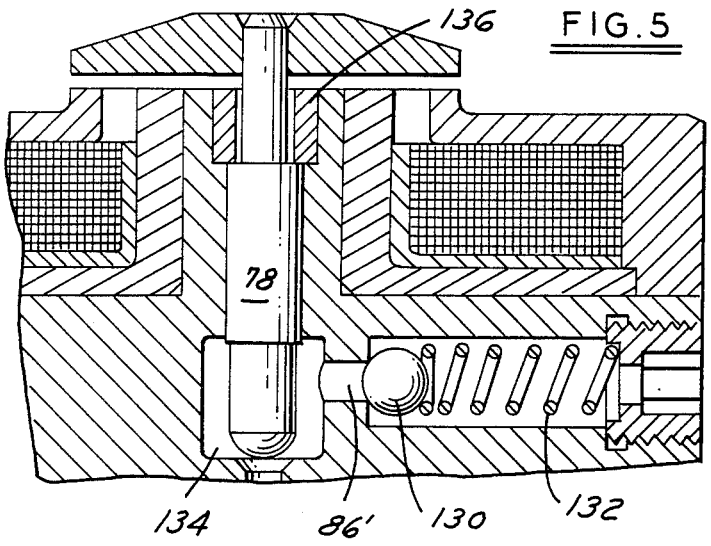
FIGS. 5 and 6 are cross-sectional views similar to FIGS. 2 and 3, respectively, illustrating modifications thereof.
Figure 6:
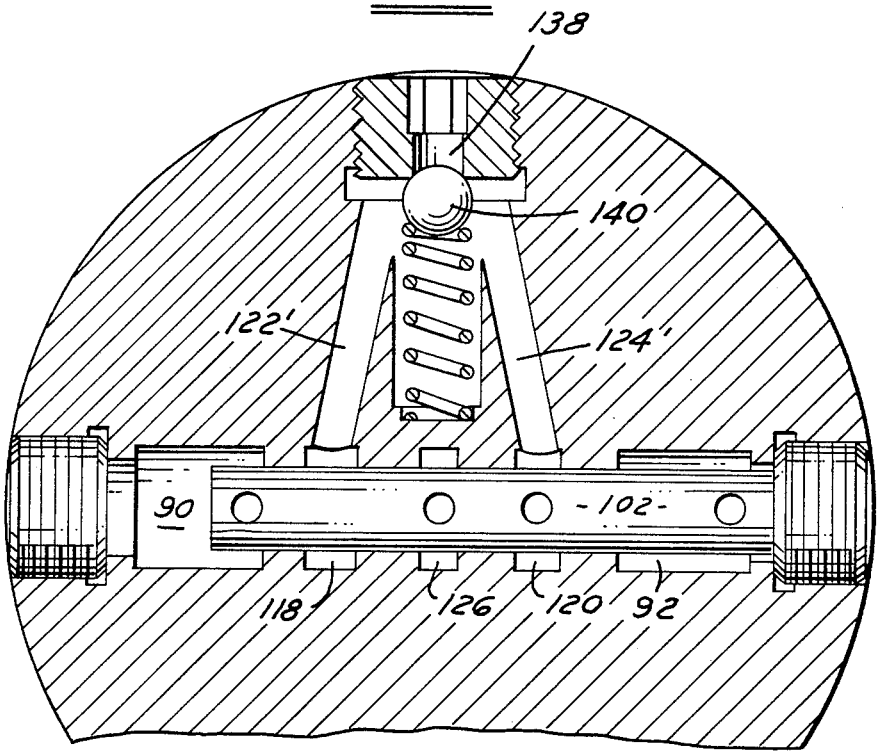

FIGS. 2–4 illustrate a construction in which the solonoid operated valve 78 is biased closed by a light valve seating spring 83, and shuttle valve 100 is supplied with fuel at low pressure directly from the fuel supply line 54 (FIG. 1) through fuel annuli 118 and 120. FIGS. 5 and 6 illustrate modified constructions of the solenoid valve-shuttle valve combination. FIG. 5, for example, shows the return line 86 in FIG. 2 modified to include a ball type check valve 130 biased by a spring 132 to close the return line 86'. The check valve 130 assures the required pressure differential between the two end plenums 90 and 92 of the shuttle valve which, during the spill of the fuel when valve 78 is open, keeps the shuttle valve 102 in the extreme right or left hand positions depending upon which plunger is on the pumping stroke. The need for spring 83 in FIG. 1 is eliminated, and the fuel pressure in the valve chamber 134 acting against the end of valve 78 keeps the spill valve reliably pressed against a stop 136 during the spill function. The fixed position of spill valve 78 during the spilling of fuel past the valve assures equal valve travel distance of the valve, and thus, equal solenoid valve energization time for all engine speeds.

FIG. 6 shows the inlet fuel supply lines 122' and 124', which in FIG. 3 are individually supplied with fuel, combined in a parallel flow relationship from a main fuel inlet supply line 138. The latter is closed and controlled by a spring pressed check valve 140 that assures fast and reliable shift of shuttle valve 102 from one extreme position to another when the direction of the plunger motion is reversed by camshaft 18.

Figure 7:
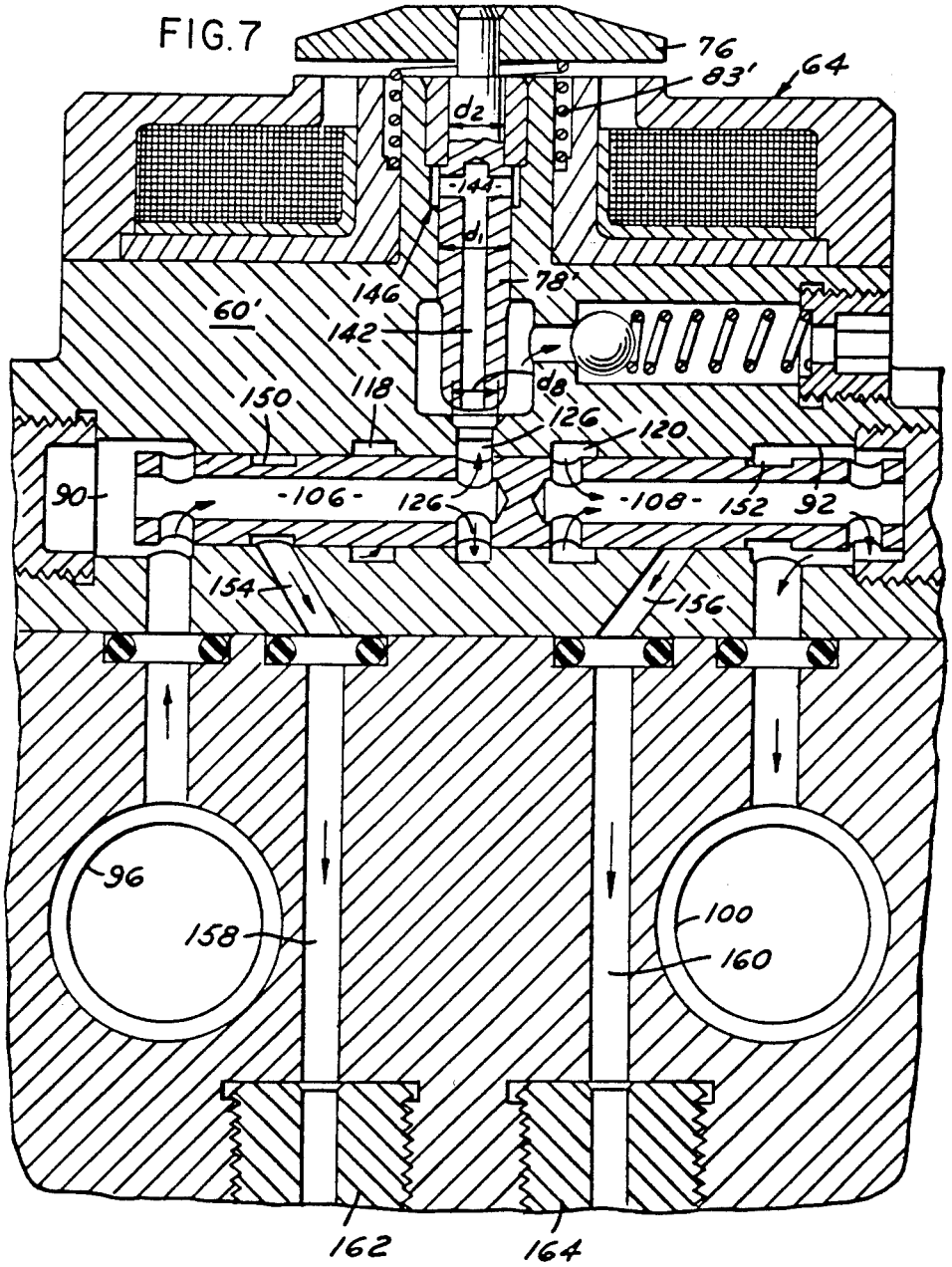
FIG. 7 is a cross-sectional view similar to FIGS. 2 and 4 illustrating a further modification.

FIG. 7 shows a modification of the spill port control valve 78 shown and described in connection with FIGS. 2–6. The spill valve in this case is of a design that makes it insensitive to the magnitude of the injection pressure acting against the lower end of the valve. As shown, valve 78' is installed in the valve body 60' with tight clearances along the surfaces with diameters $d_1$ and $d_2$ comparable to those existing between the plunger 14 and its bore 12. The diameters $d_1$ and $d_2$ are selected so that the valve gage diameter $d_g$ is approximatley equal to $d_g=\sqrt{d_1 d_2^2}$. During injection, when the spill valve 78' is closed, an axial bore 142 through the valve that connects with a cross hole 144 connects the lower end of spill port 82 with a balancing chamber 146. The injection pressure in spill port 82 acting on the valve gage diameter area $$A_g = \frac{\pi dg^2}{4}$$

produces an axial force opposing the solonoid closing force. However, the injection pressure is also transmitted through the axial bore 142 to the balancing chamber 146 where it acts on a differential area $$A_d = \frac{\pi(d_1^2 - d_2^2)}{4}$$

and produces a balancing force in the same direction as the solenoid force. Since $A_g=A_d$, the two pressure forces cancel each other and the required solenoid force to maintain the spill port valve 78' closed is limited to whatever force is necessary to overcome the preload of return spring 83' and to seal the spill port 82. Therefore, the required solenoid force need be only slightly more than that of the force of the spring 83' and is completely independent of the magnitude of the injection pressure. The spring 83', acting on the armature 76, will keep the valve 78 in fully opened position during the spill.

Figure 8:
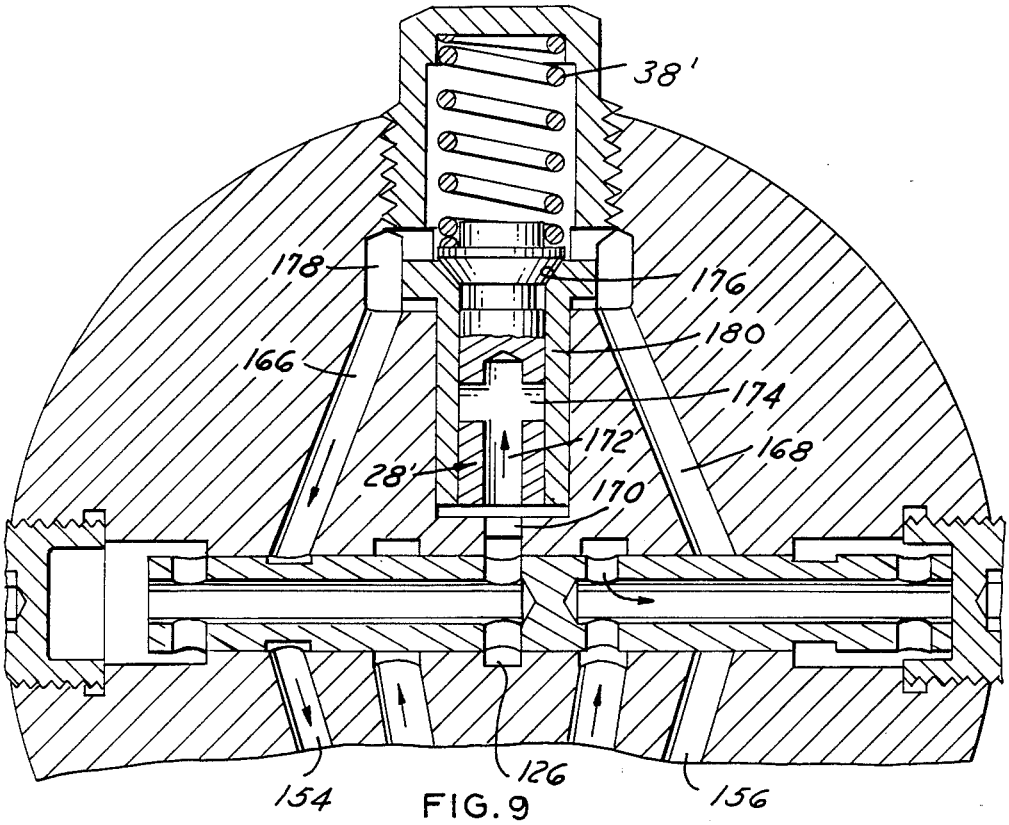
FIGS. 8 and 9 are further cross-sectional views illustrating still further embodiments of the invention.
Figure 9:
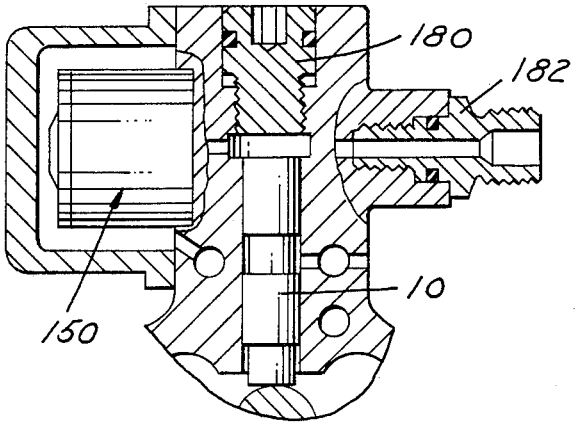

FIGS. 7–9 show still another embodiment of the invention in which the fuel delivery valve is integrated into the valve housing 60 and operable in conjunction with two of the plungers to supply fuel to two engine cylinders instead of the construction as illustrated in connection with FIGS. 1–4. In FIG. 7, the outer surface of the shuttle valve 102 is provided with a pair of fuel grooves 150 and 152. The valve body 60 in this case is provided with, as seen best in FIG. 8, a pair of angled fuel passages 154 and 156 connected through the pump housing, as best seen in FIG. 7, by further passages 158 and 160 to a pair of fuel injection outer fittings 162 and 164, each leading to an individual engine cylinder. The valve body also contains a further pair of fuel delivery lines 166 and 168 (FIG. 8) that are arranged in parallel flow relationship to a main fuel delivery line 170 connected directly to the fuel annulus 126 shown in FIG. 7. The delivery valve 28 per se is similar in construction to that already described in connection with the FIG. 1 showing. The valve contains an axial bore 172 intersecting a cross bore 174. An upper conical land portion 176 seats against a mating portion 178 in a subhousing 180 to block flow between the bore 172 and the two delivery lines 166 and 168. A spring 38' seats the valve until the preload fuel injection pressure level is reached.

In FIG. 7, it will be seen that in the position of shuttle valve 102 shown, the groove 150 is connected through its respective passage 166 with the delivery valve chamber 178 and through passage 154 to fuel injection line 158. Line 168 at this time is blocked. Since the delivery valve in FIGS. 7 and 8 will control the flow of two plungers instead of just one, the tops of each of the plunger bores 12 in FIG. 1 in this case are closed by special plugs 180, as shown in FIG. 9, in contrast to the construction shown in FIG. 1. The outlet fittings, therefore, now are located elsewhere, as indicated in FIG. 9 at 182.

Before proceeding to a brief description of the operation, it should be noted that the quantity of fuel injected into each engine cylinder during any particular operating phase of the engine will be determined solely as a function of the time that the spill control valve 78, 78' is closed. Control of the duration of energization of the solenoid will be made by a suitable engine control, not shown, such as a microprocessor unit, for example, which will have a plurality of input parameters, such as engine speed, manifold vacuum level, temperature, etc. The microprocessor unit will determine during particular engine speed and load and other conditions what should be the appropriate quantity of fuel for injection into the particular engine cylinder and the appropriate voltage then will be supplied to solenoid assembly 64 to close the spill valve to provide that amount of fuel delivery.

In operation, therefore, the engine driven camshaft 18 will rotate and force one of the plungers 14 upwardly through a pumping stroke. Simultaneously, another of the plungers will at that time be moving downwardly through an intake or suction stroke. Spill control valve 78 will now be energized moving the valve to the full line position shown in FIG. 2 to close the spill port 82. The one plunger in bore 98, for example, will now inject fuel into the engine cylinder associated with it. The fuel acting in plenum 90 (FIG. 2) against the end of bore 106 of shuttle valve 102 will maintain the valve in the position shown in FIG. 2, permitting a supply of fuel at a low pressure to be made through bore 108 to the plunger bore 100. When fuel injection is to be terminated, solenoid 64 will be deenergized, spill valve 78 opened by the fuel pressure thereagainst (FIG. 2), and the delivery valve 36 will seat.

When the camshaft 18 moves to reverse the operation, the plunger in bore 98 will move in a downward intake stroke and the plunger in bore 100 through its pumping stroke. The reversal of the pressure differential force between plenums 90 and 92 now will move the shuttle valve 102 to the extreme left as indicated in FIG.

4 to connect plenum 92 with the spill port 82. The energization of solenoid 64 and closing of the spill port valve 78 will then allow pressurization of the fuel in plenum fuel chamber 44 associated with the plunger bore 100. When the fuel injection is to be terminated, voltage to the solenoid assembly 64 again will be terminated, permitting spring 83 (FIG. 2) to move the spill port valve 78 upwardly and thereby vent the fuel from the fuel chamber 44 past the spill valve into the return line 86.

In the embodiments shown in FIGS. 1–8, pressurization of the fuel in fuel chamber 44 by closing of the spill port valve causes an unseating of the retraction type delivery valve 28 and passage of the fuel out to one engine cylinder. In the FIG. 8 embodiment, depending upon the position of shuttle valve 102', the fluid flowing past the delivery valve 28 will flow into either of lines 166 and 168 and out therefrom to the individual cylinder as a function of the movement of the shuttle valve.

From the foregoing, it will be seen that the invention provides an economical and efficient fuel injection pump assembly, and one in which only a single solenoid need be used to control the flow of fuel to and from two of the pumping plungers. Furthermore, it will be seen that the invention discloses a fuel injection pump which in one embodiment utilizes a delivery valve for each plunger of the engine; whereas, in another embodiment, only a single delivery valve need be used to control the fuel flow to and from two pumping plungers to two engine cylinders. It will also be seen that another feature of the invention is to provide a spill port control valve that is essentially fuel pressure balanced so that the force of any solenoid needed to close the valve is only that necessary to overcome the spring force urging the valve open.

While the invention has been shown and described in its preferred embodiments, it will be clear to those skilled in the arts to which it pertains, that many changes and modifications may be made thereto without departing from the scope of the invention.

We claim:

1. A fuel injection pump of the multiple plunger spill port type for an automotive type internal combustion engine, the pump including a housing having a central cavity therein receiving a rotatable engine driven camshaft, a pair of axially spaced stationary pump plunger bores each projecting radially through the housing from the camshaft and each reciprocably mounting a plunger engageable with the camshaft for movement thereby upwardly through a fuel pumping stroke and downwardly through a fuel intake stroke, each bore defining a fuel chamber contiguous to the plunger end opposite to that engaged by the camshaft, each bore having a fuel inlet/spill passage through the wall of the bore contiguous to each chamber for the supply of fuel to and the spill of fuel therefrom, a fuel discharge passage containing fuel pressure responsive means therein connecting each of the chambers individually to an engine cylinder, a source of low pressure fuel, fuel supply lines connecting the source to each of the fill/spill passages and fuel chambers, a low pressure fuel return line, a spill port in the line connected in parallel fuel flow relationship to each of the fill/spill passages, and spill port fuel flow control valve means moveably associated with the supply and return lines to block or permit flow therethrough to control the pressurization of fuel in one of the fuel chambers and its discharge line while supplying fuel at low pressure to another of the chambers, and vice versa, the valve means including a single spill control valve movable to block or unblock the spill port, electromagnetic means energizable to move the spill valve to a spill port blocking position, and a shuttle valve reciprocably movable between a first position connecting one of the pair of fill/spill passages to the supply line and source and the other of the pair of fill/spill passages to the spill port and return line, and vice versa for a second position, the shuttle valve being fuel pressure movable to its reciprocable positions as a function of the pumping movement of the respective plungers associated therewith directing fuel against various opposite portions of the shuttle valve.

2. A pump as in claim 1, the shuttle valve including a valve bore having an outlet connected to the spill port and a pair of inlets connected one to each of the fill/spill passages, the selective energization of the electromagnetic means closing the spill port during the pumping stroke of one of the pair of plungers to effect pressurization of its associated fuel chamber and the discharge of fuel to the engine cylinder associated therewith simultaneous with the intake stroke of the other of the pair of plungers supplying fuel to its respective fuel chamber.

3. A pump as in claim 1, wherein each bore contains a retraction type fuel delivery valve contiguous to its fuel chamber and concentrically arranged within the bore to close one end thereof, the delivery valve connecting the latter chamber and discharge passage and being openable upon the attainment of a predetermined fuel pressure in the chamber to supply fuel to the engine cylinder.

4. A pump as in claim 1, including a preloaded retraction type delivery valve in the discharge passage upstream of the engine cylinder openable above a predetermined fuel pressure in the fuel chamber to supply fuel to the cylinder.

5. A pump as in claim 1, wherein the electromagnetic means includes a solenoid having a movable armature secured to the spill valve, and spring means lightly biasing the spill valve to a position closing the spill port and effecting a pressure buildup in the fuel chamber connected at that time thereto by the shuttle valve.

6. A pump as in claim 1, wherein the electromagnetic means includes a solenoid having a movable armature secured to the spill valve, spring means lightly biasing the spill valve to a position closing the return line effecting a pressure buildup in the fuel chamber connected at that time thereto by the shuttle valve, the force of the spring means being below the predetermined opening pressure force of the delivery valve to effect opening of the return line prior to opening of the delivery valve as long as the solenoid is deenergized.

7. A pump as in claim 2, the valve bore including fuel plenums at opposite ends of the shuttle valve constituting the fuel inlets each connected to a different plunger fuel chamber, the spill port being connected to the valve bore between the plenums to direct fuel to and receive fuel from either plenum as a function of the position of the shuttle valve, the fuel pressure differential between plenums urging the shuttle valve in one direction or the other as a function of the position of the shuttle valve.

8. A pump as in claim 2, the source of fuel including a pair of fuel supply lines connected to the valve bore on opposite sides of the spill port to supply fuel to the individual fuel chambers as a function of the position of the shuttle valve.

9. A pump as in claim 8, including a spring loaded check valve associated with the supply lines to maintain a minimum fuel pressure in the lines against the spill valve and shuttle valve biasing the spill valve open and the shuttle valve in one direction.

10. A pump as in claim 1, including a spring closed check valve in the return line downstream of the spill valve establishing a minimum fuel pressure force against the shuttle valve biasing the shuttle valve in one direction in response to fuel pressure thereagainst by fuel from a plunger moving through its pumping stroke.

11. A pump as in claim 4, including a spring closed check valve in the return line downstream of the spill valve establishing a minimum fuel pressure force against the spill valve biasing the spill valve open, the force biasing the spill valve open being less than the predetermined fuel pressure level for opening the delivery valve.

12. A pump as in claim 1, the shuttle valve including a housing having a bore defining a fuel plenum at opposite ends, each fuel plenum being connected to a different plunger fuel chamber, a centrally located fuel annulus fuel connected to the spill port and return line, and a plurality of fuel supply annuli between the plenums essentially equally spaced on opposite sides of the centrally located annulus, the bore reciprocably receiving therein the shuttle valve consisting of a sleeve type valve having a central partition dividing the valve into two axially extending bores each open to a different plenum, a pair of inlets through the sleeve contiguous to the partition and on opposite sides thereof whereby movement of the valve in one direction or the other aligns one of the inlets with the fuel spill port while aligning the other of the pair of inlets with one of the fuel supply annuli for the supply of fuel to the plenum and plunger fuel chamber associated therewith, and vice versa when the valve is moved in the opposite direction, the force of the fuel under pressure in one plenum during the pumping stroke of the plunger associated therewith creating a pressure differential between plenums biasing the shuttle valve to the position connecting the pressurized fuel to the spill port return line whereupon simultaneous energization of the electromagnetic means closes the return line and permits further pressurization of the fuel in the fuel chamber associated with the respective plenum.

13. A pump as in claim 1, the spill valve being movable into the spill port to a closed position blocking the return line, the fuel pressure acting on the spill valve in its closed position opposing the force of the electromagnetic means that forces the spill valve closed, the spill valve having a central bore therein directing fuel from the end blocking the return line to an opposite differential area end of the spill valve to apply fuel pressure thereto to balance the fuel pressure force on the opposite end and thereby reduce the force of the electromagnetic means necessary to a force only slightly greater than the means biasing the spill valve to an open position.

14. A pump as in claim 12, the shuttle valve sleeve having a pair of annular fuel grooves located one to each side of the spill port, a further conduit connected at one end to the spill port having branch passages connected in parallel flow relationship to each of the annular fuel grooves, a fuel delivery valve in the conduit upstream of the branch passages, the pair of fuel grooves being alignable one at a time with further fuel passages each connected to an engine cylinder as a function of movement of the shuttle valve in one direction or the other to deliver pressurized fuel past the delivery valve first to one cylinder and subsequently to the other upon reciprocatory movement of the shuttle valve.

15. A pump as in claim 1, wherein a single retraction type delivery valve assembly is operatively fluid associated with the shuttle valve for controlling fuel flow from a pair of plungers to a pair of engine cylinders on a one-to-one basis in response to reciprocatory movement of the shuttle valve, the delivery valve assembly including a single fuel inlet line connected to the plunger fuel chambers in one flow path through the shuttle valve and a pair of branch outlet lines each connected to a separate discharge passage in another path past the shuttle valve.

* * * * *